US010597587B2

(12) United States Patent
Kuah et al.

(10) Patent No.: US 10,597,587 B2
(45) Date of Patent: Mar. 24, 2020

(54) PROCESS FOR REMOVING HEAVY METALS FROM HYDROCARBONS

(71) Applicant: Petroliam Nasional Berhad (Petronas), Kuala Lumpur (MY)

(72) Inventors: Yong Cheun Kuah, Kuala Lumpur (MY); John David Holbrey, Belfast (GB); Martin Philip Atkins, Belfast (GB)

(73) Assignee: Petroliam Nasional Berhad (Petronas), Kuala Lumpur (MY)

( * ) Notice: Subject to any disclaimer, the term of this patent is extended or adjusted under 35 U.S.C. 154(b) by 323 days.

(21) Appl. No.: 15/554,977

(22) PCT Filed: Mar. 2, 2016

(86) PCT No.: PCT/EP2016/054481

§ 371 (c)(1),
(2) Date: Apr. 13, 2018

(87) PCT Pub. No.: WO2016/139280

PCT Pub. Date: Sep. 9, 2016

(65) Prior Publication Data

US 2018/0051216 A1 Feb. 22, 2018

(30) Foreign Application Priority Data

Mar. 3, 2015 (MY) ..... PI2015700674

(51) Int. Cl.

| | |
|---|---|
| ***C10G 29/06*** | (2006.01) |
| ***B01D 53/00*** | (2006.01) |
| ***C10G 25/00*** | (2006.01) |

(52) U.S. Cl.

CPC ..... *C10G 29/06* (2013.01); *C10G 25/003* (2013.01); *C10G 2300/205* (2013.01)

(58) Field of Classification Search

CPC ..... C10G 25/003; C10G 29/06; C10G 2300/205; B01D 53/00

See application file for complete search history.

(56) References Cited

U.S. PATENT DOCUMENTS

| | | | | |
|---|---|---|---|---|
| 4,814,152 | A * | 3/1989 | Yan | B01D 53/8665 423/210 |
| 5,336,835 | A * | 8/1994 | McNamara | B01J 20/0288 502/417 |
| 2003/0104937 | A1 | 6/2003 | Sinha | |
| 2014/0001100 | A1* | 1/2014 | Abai | C10G 25/003 208/253 |

FOREIGN PATENT DOCUMENTS

| | | | |
|---|---|---|---|
| CN | 103237870 | A | 8/2013 |
| FR | 3007768 | | 1/2015 |
| FR | 3007768 | A1 * | 1/2015 |
| GB | 2484301 | | 4/2012 |

OTHER PUBLICATIONS

International Search Report dated May 6, 2016.

* cited by examiner

*Primary Examiner* — Randy Boyer
(74) *Attorney, Agent, or Firm* — Ryan T. Grace; Advent, LLP

(57) ABSTRACT

This invention provides a process for removing mercury, from a mercury-containing hydrocarbon fluid. More specifically, the invention relates to a process for the removal of mercury from a mercury-containing hydrocarbon fluid feed comprising the steps of: (i) contacting the mercury-containing hydrocarbon fluid feed with a metal perhalide having the following formula: $[M]^+[X]^-$ wherein: $[M]^+$ represents one or more metal cations wherein the metal has an atomic number greater than 36; an atomic radius of at least 50 pm and a 1st ionization energy of less than 750 $kJmol^{-1}$; $[X]^-$ represents one or more perhalide anions; and (ii) obtaining a hydrocarbon fluid product having a reduced mercury content compared to mercury-containing hydrocarbon fluid feed.

20 Claims, 1 Drawing Sheet

PROCESS FOR REMOVING HEAVY METALS FROM HYDROCARBONS

Figure 1:
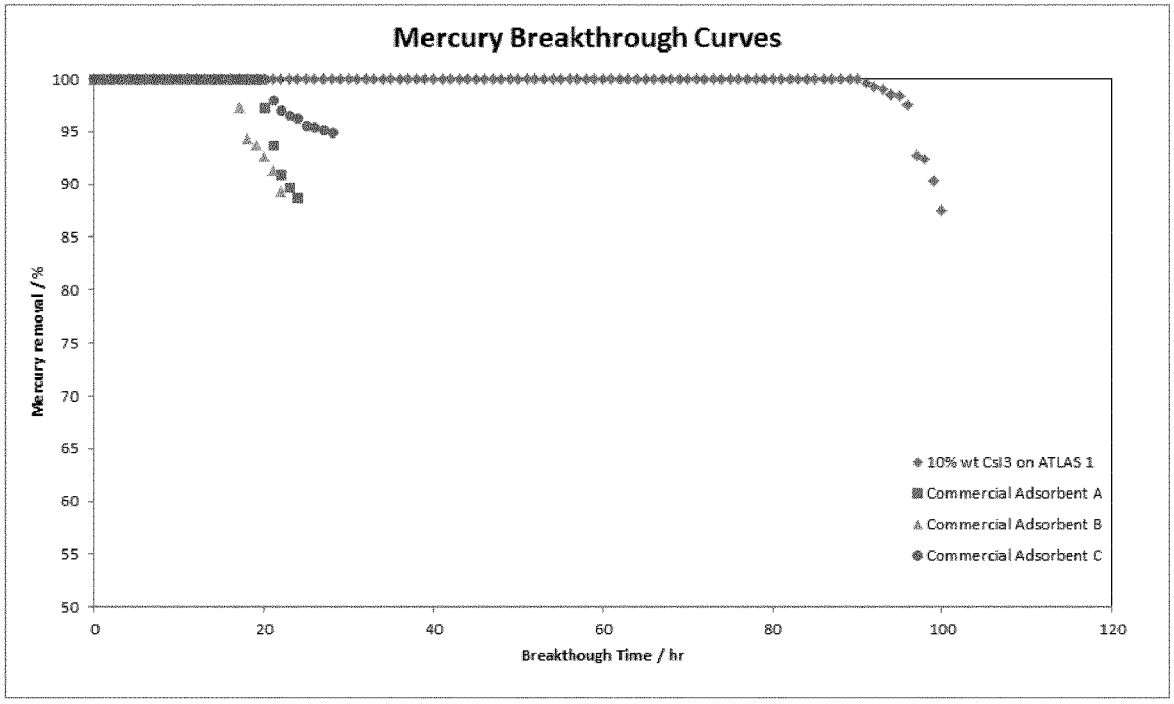

The present invention relates to a process for the removal of toxic heavy metals, particularly mercury, from a heavy metal-containing hydrocarbon feed. More specifically, the invention relates to a process of extracting mercury from gaseous or liquid hydrocarbons using a metal perhalide.

Liquid and gaseous hydrocarbons obtained from oil and gas fields are often contaminated with mercury. In particular, liquid and gaseous hydrocarbons obtained from oil and gas fields in and around the Netherlands, Germany, Canada, USA, Malaysia, Brunei and the UK are known to contain mercury. As reported by N. S. Bloom (Fresenius J. Anal. Chem., 2000, 366, 438-443), the mercury content of such hydrocarbons may take a variety of forms. Although elemental mercury tends to predominate, particulate mercury (i.e. mercury bound to particulate matter), organic mercury (e.g. dimethylmercury and diethylmercury) and ionic mercury (e.g. mercury dichloride) may also be found in naturally occurring hydrocarbon sources. The mercury concentration in crude oils can range from below 1 part per billion (ppb) to several thousand ppb depending on the well and location. Similarly, mercury concentrations in natural gas can range from below 1 $ng \cdot m^{-3}$ to greater than 1000 $\mu g \cdot m^{-3}$.

The presence of mercury in hydrocarbons is problematic due to its toxicity. In addition, mercury is corrosive towards hydrocarbon processing equipment, such as that used in oil and gas refineries. Mercury can react with aluminium components of hydrocarbon processing equipment to form an amalgam, which can lead to equipment failure. For example, pipeline welds, cryogenic components, aluminium heat exchangers and hydrogenation catalysts can all be damaged by hydrocarbons contaminated with mercury. This can lead to plant shutdown, with severe economic implications, or, in extreme cases, to uncontrolled loss of containment or complete plant failure, with potentially catastrophic results.

Furthermore, products with high levels of mercury contamination are considered to be of poorer quality, with the result that they command a lower price.

Elemental mercury forms amalgams with gold, zinc and many metals and reacts with oxygen in air when heated to form mercury oxide, which then can be decomposed by further heating to higher temperatures. Mercury does not react with most acids, such as dilute sulfuric acid, though oxidising acids such as concentrated sulfuric acid and nitric acid or aqua regia dissolve it to give sulfate, and nitrate and chloride. Mercury reacts with atmospheric hydrogen sulfide and even with solid sulfur flakes. This reaction of mercury with elemental sulfur is utilised in mercury spill kits which contain sulfur powder to absorb mercury vapours (spill kits also use activated charcoal and powdered zinc to absorb and amalgamate mercury).

The reactivity of elemental mercury to bromine and chlorine is well known, as a basic chemical reaction (for example, see Cotton and Wilkinson, *Comprehensive Inorganic Chemistry,* $4^{th}$ Edition, p 592.) and has been recognised as one mechanism for the formation of inorganic mercury species in the atmosphere (see for example, Z. Wang et al., *Atmospheric Environment,* 2004, 38, 3675-3688 and S. E. Lindberg, et al., *Environ. Sci. Technol.,* 2002, 36, 1245-1256). This reactivity of mercury with halogens has been utilised in flue-gas scrubbing technologies to remove mercury vapour by high temperature reaction with either bromine or chlorine forming inorganic mercury species that are readily extracted into aqueous media (for example, S-H. Lui, et al., *Environ. Sci. Technol.,* 2007, 41, 1405-1412).

Bromine has been used for leaching of gold from ores (used either directly, or produced in situ from bromide salts and chlorine gas), however this approach has been superseded by economically cheaper cyanide leaching processes.

When working with bromine or chlorine under ambient or near-ambient temperatures and pressures, there are significant difficulties and hazards that are associated with the corrosivity and toxicity of both bromine and chlorine vapours as well as the incompatibility of the halogens with many metals. Bromine is known to oxidise many metals to their corresponding bromide salts, with anhydrous bromine being less reactive toward many metals than hydrated bromine. Dry bromine reacts vigorously with aluminium, titanium, mercury as well as alkaline earths and alkali metals forming metal bromide salts.

Organic perhalide salts (also known as trihalide salts) have a variety of known applications, including use as sterilising agents; for bleaching of textiles; for wart removal; and as aqueous antifouling agents. In addition, organic perhalide salts may be used as highly efficient brominating agents in the preparation of brominated organic compounds, including those having anti-inflammatory, antiviral, antibacterial, antifungal, and flame-retardant properties.

A number of approaches to the removal of mercury from hydrocarbons have been proposed. These include: scrubbing techniques using fixed bed columns containing sulfur; transition metal or heavy metal sulfides on an activated support; elemental bismuth and/or tin incorporated into silica, alumina or activated carbon; oxidation followed by complexation with sulfur-containing compounds; oxidation followed by solvent extraction; and the use of ionic liquids.

A limited number of approaches have been proposed for the removal of heavy metals from metal-containing hydrocarbon fluid feeds incorporating the use of metal perhalides. U.S. Pat. No. 5,620,585 discloses a process for the extraction of precious metals, such as gold, silver, platinum and palladium, by contacting a metal-containing source with a brominated leaching solution. That document is concerned with the known use of molecular bromine as a means for recovery of precious metals, but seeks to provide a composition which does not suffer from a high bromine vapour pressure, which makes handling and shipping difficult.

U.S. Pat. No. 5,620,585 proposes the use of a brominated leaching solution produced by diluting an inorganic perbromide concentrate with water to create a flowing solution. The inorganic perbromide concentrate is prepared by adding metal bromide, or other metal halide salt, and hydrogen halide to a protic solvent, before adding liquid bromine to the acidic bromide salt solution. This is said to ensure the presence of an excess of bromide ion for reaction with the liquid bromine to form perbromide. According to U.S. Pat. No. 5,620,585, the metal perbromides may comprise alkali metals such as sodium, potassium, and lithium or alkaline earth metal salts such as calcium.

Notably, the process for extraction of precious metals from a metal-containing source according to U.S. Pat. No. 5,620,585 does not involve direct contact with a neat metal perbromide but relies on the presence of molecular bromine contained in the leaching solution to oxidise or complex the precious metals. Moreover, there is no mention of the process being useful for the extraction of toxic heavy metals, such as mercury.

The use of a solution comprising low molecular weight metal perhalides, such as perhalides of sodium, potassium, lithium and calcium, in U.S. Pat. No. 5,620,585 is consistent with the known stability issues associated with neat salts of such metal perhalides which make them prone to disproportionation, and therefore unusable. Typically, it is only in the solution phase in which metal perhalides have found any application, since in that form the they are significantly more stable. For instance, *J. Chem. Soc.,* 1877, 31, pages 249 to 253 describes the extremely deliquescent nature of neat potassium triiodide salt and speculates that the triiodide is only capable of existing in concentrated aqueous solutions. There is however a number of disadvantages associated with the use of metal perhalide solutions. For example, such solutions require specialist handling, which can be expensive, and there are difficulties associated with transportation compared with solid equivalents.

The present invention is based on the surprising discovery that certain heavy metal perhalides can be used as effective agents to remove mercury from liquid and gaseous hydrocarbons, without additives and without the need for chemical modification of the mercury. In particular, it has unexpectedly been found that perhalides of certain higher molecular weight metals exhibit a high degree of stability towards disproportionation whilst in the form of a neat salt. More specifically, the metal perhalides used in the present invention comprise a metal with an atomic number greater than 36, an atomic radius of at least 150 picometers (pm) and a $1^{st}$ ionization energy of less than 750 $kJmol^{-1}$.

The metal perhalides utilised in connection with the present invention may be advantageously employed in the form of a neat salt rather than as a component of a solution. Furthermore, it has also surprisingly been found that these metal perhalides can be used to remove mercury from liquid and gaseous hydrocarbons at, or around, ambient temperatures. Indeed, the metal perhalides can be used effectively across a wide range of temperatures, so long as the upper limit of temperature is below the decomposition temperature of the metal perhalide. Preferably, the metal perhalides are used at, or around, ambient temperatures (e.g. between 20 and 35° C.).

Thus, in a first aspect, the present invention provides a process for the removal of mercury from a mercury-containing hydrocarbon fluid feed comprising the steps of:

(i) contacting the mercury-containing hydrocarbon fluid feed with a metal perhalide having the formula:

$$[M]^+[X]^-$$

wherein: $[M]^+$ represents one or more metal cations wherein the metal has an atomic number greater than 36; an atomic radius of at least 150 pm and a $1^{st}$ ionization energy of less than 750 $kJmol^{-1}$; $[X]^-$ represents one or more perhalide anions; and (ii) obtaining a hydrocarbon fluid product having a reduced mercury content compared to the mercury-containing hydrocarbon fluid feed.

In accordance with the present invention, $[M]^+$ represents one or more metal cations wherein the metal has an atomic number greater than 36, an atomic radius of at least 150 pm, and a $1^{st}$ ionization energy of less than 750 $kJmol^{-1}$. The metal may be selected from alkali metals, alkaline earth metals, transition metals, lanthanides and actinides, provided that the metal satisfies the requirements of atomic number, atomic radius and $1^{st}$ ionization energy specified above. The term "metal", used in reference to the metal perhalide, is also intended to encompass metalloids that behave in the same way as metals in the process of the invention, provided that they satisfy the requirements of atomic number, atomic radius and $1^{st}$ ionization energy specified above.

Preferably, $[M]^+$ is selected from one or more alkali metal cations or post-transition metal cations. More preferably, $[M]^+$ is selected from rubidium, caesium, thallium or bismuth cations. Most preferably, $[M]^+$ is a caesium cation.

References to atomic radii herein are to empirically measured covalent radii, as published in Slater J C., "Atomic Radii in Crystals", *Journal of Chemical Physics* 41 (10), 1964, pages 3199 to 3205. As would be appreciated by the person of skill in the art, the reference to the $1^{st}$ ionization energy for the metal is that which is measured when the metal is in a gaseous state. Atomic radii and $1^{st}$ ionization energies for preferred metals are provided in Table 1.

TABLE 1

| Metal | Atomic Radius (pm) | $1^{st}$ Ionization Energy ($kJmol^{-1}$) |
|---|---|---|
| Caesium | 260 | 376 |
| Rubidium | 235 | 403 |
| Thallium | 190 | 589 |
| Bismuth | 160 | 703 |

In accordance with the present invention, $[X]^-$ may comprise one or more perhalide anions. The stability of the perhalide anion is generally enhanced the more symmetrical the polyhalide anion is and the larger the central atom. Thus, for instance, stability is known to decrease in the sequence $[I_3]^- > [IBr_2]^- > [ICl_2]^- > [I_2Br]^- > [Br_3]^- > [BrCl_2]^- > [Br_2Cl]^-$.

In one embodiment of the present invention, $[X]^-$ comprises at least one perhalide anion selected from $[I_3]^-$, $[BrI_2]^-$, $[Br_2I]^-$, $[ClI_2]^-$, $[Br_3]^-$, $[ClBr_2]^-$, $[BrCl_2]^-$, $[ICl_2]^-$, or $[Cl_3]^-$; more preferably $[X]^-$ comprises one or more perhalide ion selected from $[BrI_2]^-$, $[Br_2I]^-$, $[ClI_2]^-$, $[ClBr_2]^-$, or $[BrCl_2]^-$; still more preferably $[X]^-$ comprises one or more perhalide anion selected from $[Br_2I]^-$, $[ClBr_2]^-$ or $BrCl_2]^-$; and most preferably $[X]^-$ is $[ClBr_2]^-$. In a further embodiment, $[X]^-$ comprises one or more perhalide anion selected from $[I_3]^-$, $[Br_3]^-$, or $[Cl_3]^-$, and is more preferably $[I_3]^-$.

It has surprisingly been found that metal perhalides in accordance with the present invention can effectively extract mercury from a hydrocarbon fluid feed, producing comparable results with an ionic liquid comprising the same perhalide anion. However, metal perhalides are a much more cost effective alternative. As a representative example, the ability of caesium periodide ($CsI_3$) to extract mercury from a hydrocarbon fluid is comparable to $C_4miml_3$, but less expensive to produce.

In one embodiment of the invention, the metal perhalide used in the process of the present invention is caesium periodide.

In another embodiment of the invention, the metal perhalide used in the process of the present invention is rubidium periodide.

The metal perhalide and mercury-containing hydrocarbon fluid feed are preferably contacted in a metal perhalide: hydrocarbon ratio of 1 to 10,000 moles; more preferably 1 to 1000 moles; still more preferably 1 to 100 moles; still more preferably 1 to 10 moles; and most preferably 1 to 5 moles of the metal perhalide are contacted with the mercury-containing hydrocarbon fluid feed per mole of mercury metal in the mercury-containing hydrocarbon fluid feed.

The metal perhalide may be used in a solid state in the form of a neat salt or immobilised on a solid carrier material. Additionally, the metal perhalide may also be used in the form of a solid particulate suspension in a suitable solvent. Alternatively, and where appropriate, the metal perhalide may be used in the form of a solution of the metal perhalide. In that case, the perhalide anion should have a large enough half-life in the solvent such that significant disproportionation does not occur prior to contact with the mercury-containing hydrocarbon fluid feed.

Preferably, the metal perhalide is used in the method of the invention in a solid state in the form of a neat salt or immobilised on a solid carrier material, more preferably immobilised on a solid carrier material. This is particularly advantageous in terms of handling and shipping of the metal perhalide for use with the invention. In a further preferred embodiment, the metal perhalide is used in a solid state at a purity of at least 90%, preferably at least 95%, more preferably at least 98%, for example 99%.

It is preferred that the mercury present in the hydrocarbon fluid feed is initially in an oxidation state below its maximum (for example 0, +1 or +2) and is oxidised through contact with the metal perhalide to a higher oxidation state, with concomitant reduction of the perhalide ion to three halide ions. In a preferred embodiment, the mercuric species is less soluble in the hydrocarbon fluid feed after oxidation to the higher oxidation state. In a further preferred embodiment, the mercuric species in the higher oxidation state forms a complex ion with one or more of the halide ions that are formed in the reduction of the perhalide ion. Preferably, the complex ion formed is a halometallate ion. As a representative example, elemental mercury(0) reacts with a metal perbromide to form a mercury(II) species which is complexed by bromide ions to form a bromomercurate(II) anion.

Without being bound by any particular theory, it is believed that metal perhalides comprising perhalide anions can oxidise mercury and mercury-containing compounds, and that the halide ions formed in the oxidation step can coordinate to the oxidised mercury to facilitate removal thereof.

Removing mercury from a mercury-containing hydrocarbon fluid feed by a method of oxidising the metal from a low to a higher oxidation state relies on the ability of the perhalide ion present in the metal perhalide to oxidise the metal. It is well known that the oxidising power of halogens follows the order $Cl_2>ClBr>Br_2>I_2$, and the half-cell redox potentials of many metals are known from the electrochemical series (see for example *CRC Handbook of Chemistry and Physics*, 87$^{th}$ Ed., CRC Press, 2006). The oxidising power of the metal perhalide can be modified and controlled by the appropriate selection of the halogen constituents of the perhalide ion. The skilled person is readily capable of selecting a metal perhalide with sufficient oxidation potential to oxidise mercury by the selection of a suitable perhalide component of the metal perhalide. The following series shows the increase in the oxidation potentials of perhalide anions from $[I_3]^-$ (lowest oxidation potential) to $[Cl]^-$ (highest oxidation potential):

$$[I_3]^-<[BrI_2]^-\sim[IBr_2]^-<[ClI_2]^-<[Br_3]^-<[ClBr_2]^-<[ICl_2]^-\sim[BrCl_2]^-\sim[Cl_3]^-$$

In another embodiment, the metal perhalide is contacted with the liquid or gaseous mercury-containing hydrocarbon fuel feed in the form of a solution, wherein the solution of the metal perhalide creates a biphasic system with the mercury-containing hydrocarbon fluid feed. The metal perhalide solution can be formed by dissolving a metal perhalide salt in a suitable hydrophilic or hydrophobic solvent.

When the metal perhalide is provided in the form of a solution comprising a hydrophobic solvent, the polarity of the solvent should be greater than that of the hydrocarbon fluid feed. The dipole moments, and therefore polarity, of common solvents are well known (see for example, *CRC Handbook of Chemistry and Physics,* 87$^{th}$ Ed., CRC Press, 2006) and so the skilled person would be readily capable of selecting a solvent which has a greater polarity than that of the hydrocarbon feed from which mercury is extracted. Preferably, the solvent is hydrophilic; more preferably the solvent is selected from a protic solvent, alcohol, organic acid or a mixture thereof. More preferably the solvent is selected from water, methanol, ethanol, propanol, butanol, acetic acid, propanoic acid, succinic acid and adipic acid.

In embodiments of the present invention where the metal perhalide is in solution, preferably, mercury is initially in an oxidation state below its maximum (for example 0, +1 or +2) and is oxidised in contact with a solution of the metal perhalide to a higher oxidation state, with concomitant reduction of the perhalide ion to three halide anions. In a preferred embodiment, the resulting mercuric species is more soluble in the metal perhalide solution after oxidation to the higher oxidation state. In a further preferred embodiment, the mercuric species generated in the higher oxidation state forms a complex ion with one or more halide ions that are formed in the reduction of the perhalide ion. Preferably, the complex ion is a halomercurate(II) ion.

Without being bound by any particular theory, it is believed that a metal perhalide solution comprising perhalide ions can oxidise mercury and mercury-containing compounds, and that the halide ions formed in the oxidation step can coordinate to the oxidised mercury to facilitate dissolution thereof in the metal perhalide solution.

Dissolution of mercury in the metal perhalide solution by a method of oxidising mercury from a low to a higher oxidation state relies on the ability of the perhalide ion present in the metal perhalide solution to oxidise the metal. Selection of metal perhalides with sufficient oxidising potential, as discussed hereinbefore, is well within the capabilities of the person of skill in the art.

In another embodiment, the metal perhalide may be in a solid state and supported on a solid carrier material prior to being contacted with the mercury-containing hydrocarbon fluid feed. Preferably the solid support material is porous. In a preferred embodiment, the solid carrier is selected from silica, alumina, silica-alumina, clay and activated carbon. In general, the supported metal perhalide for use according to this embodiment of the invention comprises from 1 to 90% by weight of metal perhalide, based on the total weight of supported metal perhalide. Where a supported metal perhalide is formed by means of an impregnation method, metal perhalide loading may suitably be from 1 to 20% by weight-based on the total weight of supported metal perhalide. Alternatively, where a binding method is utilised for preparation of the supported metal perhalide (in which a support material, binders and metal perhalide are mixed to form the supported metal perhalide) then metal perhalide loading may suitably be from 20 to 90% by weight based on the total weight of supported metal perhalide.

Advantageously, when the metal perhalide is supported on a solid carrier, the metal halide reacts with mercury in the mercury-containing hydrocarbon fluid feed to form a mercuric species which may be absorbed by the solid carrier material and thereby removed from the hydrocarbon fluid. For instance, as described hereinbefore, the reaction of the metal perhalide with mercury in the mercury-containing hydrocarbon fluid feed may form a halomercurate(II) species, which is absorbed by the solid carrier material.

Alternatively, mercury in the mercury-containing hydrocarbon fluid feed may form a non-transient complex (e.g. a coordinated mercurate species) with the metal perhalide such that the mercury also becomes immobilised on the carrier material and separated from the hydrocarbon fluid.

Mercury-containing hydrocarbon fluids that can be processed according to the present invention may comprise from 1 part per billion (ppb) of mercury to in excess of 50,000 ppb of mercury, for instance 2 to 10,000 ppb of mercury; or 5 to 1000 ppb of mercury. The mercury content of naturally occurring hydrocarbon fluids may take a variety of forms, and the present invention can be applied to the removal of elemental mercury, particulate mercury, organic mercury or ionic mercury from hydrocarbon fluids. In one preferred embodiment, the mercury is in one or more of elemental, particulate or organic form. Still more preferably, the mercury is in elemental or organic form. Thus, in one embodiment, the mercury is in elemental form. In a further embodiment, the mercury is in organic form.

The process of the invention may be applied to substantially any hydrocarbon feed which comprises mercury, and which is liquid or gaseous under the operating conditions of the process. Thus, hydrocarbon fluids that may be processed according to the present invention include liquid hydrocarbons, such as liquefied natural gas; light distillates, e.g. comprising liquid petroleum gas, gasoline, and/or naphtha; natural gas condensates; middle distillates, e.g. comprising kerosene and/or diesel; heavy distillates, e.g. fuel oil; and crude oils. Hydrocarbon fluids that may be processed according to the present invention also include gaseous hydrocarbons, such as natural gas and refinery gas. Preferably the hydrocarbon fluid comprises a liquid hydrocarbon.

The metal perhalide and the mercury-containing hydrocarbon fluid feed may be contacted by either continuous processes or batch processes. Any conventional solid-liquid, liquid-liquid, solid-gas or gas-liquid contactor apparatus may be used in accordance with the present invention, depending on the form in which the metal perhalide is utilised.

For instance, when the metal perhalide is provided in the form of a solution, the metal perhalide solution and the mercury-containing hydrocarbon fluid feed may be contacted using a counter-current liquid-liquid contactor, a co-current liquid-liquid contactor, a counter-current gas-liquid contactor, a co-current gas-liquid contactor, a liquid-liquid batch contactor, or a gas-liquid batch contactor. In one embodiment, dissolution of mercury in the metal perhalide solution is assisted by agitating the mixture of the metal perhalide solution and the heavy metal, for example by stirring, shaking, vortexing or sonicating.

In contrast, where the metal perhalide is used in the form of a neat salt or immobilised on a solid carrier, any conventional solid-liquid or solid-gas apparatus may be utilised. Thus, the solid metal perhalide, either in supported or non-supported form, may be provided as a reactant bed in a reactor which may be routinely replaced when required once the metal perhalide has been consumed. Contacting may therefore include passing the hydrocarbon fluid feed through a column packed with the supported or non-supported solid metal perhalide (e.g. in a packed bed arrangement). Mercury in the mercury-containing hydrocarbon fluid feed will thus react upon contact with the metal perhalide in the column forming a mercuric species which may be absorbed by the carrier material as described hereinbefore or otherwise immobilised on the bed. In this way, it is possible to obtain an effluent stream having a reduced content of mercury in comparison to the feed.

In addition, or alternatively, a fixed-bed arrangement having a plurality of plates and/or trays may be utilised. Additional filtering steps may also be included as part of step ii) of the process, in order to remove mercuric species from the effluent stream which have been formed following reaction with the metal perhalide and not retained in the reactor bed.

The metal perhalide is allowed to contact the mercury-containing hydrocarbon fluid feed for sufficient time to enable at least a portion of the mercury in the mercury-containing hydrocarbon fluid feed to react with the metal perhalide. Suitable timescales include from 1 minute to 60 minutes and more preferably from 2 minutes to 30 minutes.

In addition, the process may be repeated on the same mercury-containing hydrocarbon fluid feed in a series of contacting steps, e.g. two to ten, to obtain a successive reduction in the mercury content of the hydrocarbon fluid product at each step.

The process of the present invention may be used in combination with other known methods for the removal of mercury from hydrocarbon fluids. However, one advantage of the present invention is that it avoids the need for pre-treatment of the hydrocarbon fluid to remove solidified species prior to the mercury removal step.

In one embodiment of the present invention, the metal perhalide is contacted with the mercury-containing hydrocarbon fluid feed at a temperature of from −80° C. to 200° C.; more preferably from −20° C. to 150° C.; still more preferably from 15° C. to 100° C.; and most preferably from 15° C. to 40° C.

Generally, it is most economical to contact the metal perhalide and mercury-containing hydrocarbon fluid feed without the application of heat, and refinery product streams may be conveniently treated at the temperature at which they emerge from the refinery, which is typically up to 100° C.

In accordance with the process of the present invention, the metal perhalide is preferably contacted with the mercury-containing hydrocarbon fluid feed at atmospheric pressure (approximately 100 kPa), although pressures above or below atmospheric pressure may be used if desired. For instance, the process may be conducted at a pressure of from 10 kPa to 10000 kPa; more preferably from 20 kPa to 1000 kPa; still more preferably 50 to 200 kPa; and most preferably 80 to 120 kPa.

In accordance with the process of the present invention, the metal perhalide extracts at least 60 wt % of the mercury content of the heavy metal-containing hydrocarbon fluid feed. More preferably, the metal perhalide extracts at least 70 wt %; still more preferably at least 80 wt %; still more preferably at least 90 wt %; still more preferably at least 95 wt %; and most preferably greater than 99 wt % of the mercury content of the mercury-containing hydrocarbon fluid feed.

Thus, in accordance with the process of the present invention, a hydrocarbon fluid product may be obtained which comprises 10% or less of the mercury content of the heavy metal-containing hydrocarbon fluid feed. More preferably the hydrocarbon fluid product comprises 5% or less of the mercury content of the mercury-containing hydrocarbon fluid feed, and most preferably the hydrocarbon fluid product comprises 1% or less of the mercury content of the mercury-containing hydrocarbon fluid feed. Preferably the mercury concentration of the hydrocarbon fluid product of the process of the invention is less than 50 ppb, more preferably less than 10 ppb, and most preferably less than 5 ppb.

The metal perhalide used in accordance with the invention may be prepared by any known method of which the person of skill in the art is aware. For instance, the preparation of such polyhalide salts is discussed in A. I. Popov, *Halogen*

*Chemistry*, ed. V. Gutmann, Academic Press, N Y, 1967, vol. I, p. 225; A. J. Downs and C. J. Adams, *Comprehensive Inorganic Chemistry*, ed. J. C. Bailar, H. J. Emeleus, R. S. Nyholm and A. F. Trotman-Dickenson, Pergamon, Oxford, 1973, vol. II, p. 1534 et seq; E. H. Wiebenga, E. E. Havinga and K. H. Boswijk, *Adv. Inorg. Chem. Radiochem.,* 1963, 3, 133; and N. N. Greenwood and A. Earnshaw, *Chemistry of the Elements*, Pergamon, Oxford, 2nd edn., p. 835. For example, one method for preparing a metal perhalide for use with the present invention is to dissolve a metal halide in a solvent together with a halogen to form the metal perhalide before evaporating the solvent to furnish the metal perhalide neat salt.

In embodiments where a supported metal perhalide is employed, a wet incipient impregnation method may suitably be used in order to furnish the supported metal perhalide. For instance, an organic solution of the metal perhalide, which may be formed as described above, is added to a solid support having the same pore volume as the volume of the solution that is added. Capillary action may then be used to draw the solution into the pores of the solid support, before the volatile organic solvent is evaporated, thereby depositing the metal perhalide on the support surface.

The stability of the metal perhalide of the resulting salt is believed to relate to the lattice energy. In that regard, salts with lower lattice energies are considered more stable. Lattice energy is generally inversely proportional to the internuclear distance, and also generally inversely proportional to the size of the ions. Stability of the lattice in the case of a metal perhalide may be enhanced by using a large metal counter-cation, which may encourage favourable crystal packing arrangements in the lattice. It is for this reason that the atomic radius of the metal is at least 150 pm in accordance with the present invention. Furthermore, a low first ionization energy of the metal is also favourable in the formation of the ionic salt and, as such, the first ionization energy of the metal in the present invention is below 750 $kJmol^{-1}$.

It has been surprisingly found that perhalides of higher molecular weight metals (i.e. those having an atomic mass of at least 36) which satisfy the above requirements in terms of atomic radius and first ionization energy in accordance with the present invention, have high stability towards disproportionation when in the solid form. Consequently, these metal perhalides may be utilised in solid form in the process of the present invention, which is particularly advantageous in terms of handling and transportation. Moreover, the metal perhalides in the present invention may be immobilised in the solid state on a carrier support material, thus may also benefit from the advantages associated therewith. Use of the metal perhalides defined herein obviates the use of solutions of metal perhalide which can have variable molecular halogen vapour pressures, thus requiring specialist handling. In severe cases, there can be a build-up of hazardous gases where a solution of metal perhalide is left for extended periods of time.

The present invention also provides the use of a metal perhalide of the formula $[M]^+ [X]^-$ as described hereinbefore for removing mercury from a mercury-containing hydrocarbon fluid feed. Thus, in another embodiment, the present invention provides the use of a metal perhalide of the formula $[M]^+ [X]^-$ as described hereinbefore in a solid state in the form of a neat salt of immobilised on a carrier material, for removing mercury from a mercury-containing hydrocarbon fluid feed.

In a further embodiment, the present invention provides the use of caesium periodide for removing mercury from a mercury-containing hydrocarbon fluid feed.

In a still further embodiment, the present invention provides the use of rubidium periodide for removing mercury from a mercury-containing hydrocarbon fluid feed.

Embodiments of the invention described hereinbefore may be combined with any other compatible embodiments to form further embodiments of the invention. Thus, for instance, embodiments relating to the nature of $[M]^+$ and $[X]^-$ described hereinbefore can be combined in any manner.

In a further aspect, the present invention provides a process for the removal of one or more toxic heavy metals selected from cadmium, mercury, indium, thallium, germanium, tin, lead, arsenic, antimony, bismuth, selenium, tellurium and polonium from a heavy metal-containing hydrocarbon fluid feed comprising the steps of:

(i) contacting the heavy metal-containing hydrocarbon fluid feed with a metal perhalide having the formula:

$$[M^+][X^-]$$

wherein: $[M^+]$ represents one or more metal cations wherein the metal has an atomic number greater than 36 an atomic radius of at least 150 picometers (pm) and a $1^{st}$ ionization energy of less than 750 $kJmol^{-1}$; $[X^-]$ represents one or more perhalide anions; and (ii) obtaining a hydrocarbon fluid product having a reduced toxic heavy metal content compared to the heavy metal-containing hydrocarbon fluid feed.

As used herein, the term "toxic heavy metal" should be understood to include the elemental metals described hereinbefore as well as metal alloys and metal compounds comprising them such as metal oxides or metal sulfides. In addition, the toxic heavy metal may be combined with other substances, for instance, the metal may be in the form of a metal ore.

In one embodiment of the above further aspect of the invention, the toxic heavy metal removed from the heavy metal-containing hydrocarbon fluid feed is one or more of cadmium, indium, thallium, germanium, tin, lead, arsenic, antimony, bismuth, selenium, tellurium and polonium.

In the above further aspect of the invention, $[M]^+$ may be any of the metal cations described hereinbefore, and the metal cations described as preferred above are also preferred in the above further aspect of the invention. Similarly, $[X]^-$ in this aspect of the invention may be any of the perhalide anions described above, and those perhalide anions described as preferred above are also preferred in this further aspect of the invention. Thus, in one embodiment of the further aspect of the invention, the metal perhalide is caesium periodide.

In the above further aspect of the invention, the metal perhalide may be in the solid state, in the form of a neat salt or immobilised on a support material, or a metal perhalide solution as described hereinbefore.

The present invention will now be illustrated by way of the following examples and with reference to the following figures:

FIG. 1: Graphical representation for the results of mercury extraction experiments with a gaseous feed using caesium periodide and commercial mercury absorbants; and FIG. 2: Graphical representation for the results of mercury extraction experiments with a liquid hydrocarbon feed using caesium periodide and commercial mercury absorbants.

EXAMPLES

Example 1

Synthesis of Metal Perhalide

Caesium triiodide ($CsI_3$) can be purchased directly from Sigma Aldrich with 99.9% purity. The following method was also employed for preparation of caesium triiodide ($CsI_3$). Caesium iodide (0.06 g) and iodine (0.06 g) were dissolved in methanol at 25° C. and the mixture stirred for 30 minutes in a fumehood, whereupon a homogenous solution was obtained. Thereafter, the solvent was subsequently evaporated off at 70° C. to afford caesium triiodide (0.11 g) as a solid.

Example 2

Preparation of a Supported Metal Perhalide

Caesium triiodide ($CsI_3$) (1.2 g) was dissolved in methanol (7 ml) before granular virgin activated carbon (ATLAS 1, of Atlas Chemical Industries, Inc) (12 g) was added to the solution. The resulting mixture was dried at 70° C. for 12 hours to evaporate the solvent, thereby forming a solid-supported $CsI_3$ material (10 wt % on activated carbon).

Example 3

Removal of Mercury from a Gas Phase Fluid

The supported $CsI_3$ material from Example 2 was milled to afford granules of between 0.30 and 0.425 mm diameter before 0.1 g of material was introduced into a sealed reactor vessel. The reactor was supplied with a mercury-containing nitrogen gas stream at a flow rate of 60 ml/min and an inlet mercury concentration of 20 to 30 ppmv, and operated at ambient temperature and a pressure of 1 to 2 bar (100 to 200 kPa).

Commercially available, conventional sulfur-impregnated activated carbon Absorbents A, B and C (each having 8 to 12 wt. % active concentration) were also independently used in separate mercury extractions using the same experimental protocol. Breakthrough time, which is defined as the time required from the start of the extraction process to the point in time where the mercury concentration in the outlet stream of the reactor reached up to 5% of the mercury concentration of the inlet stream, was measured in each case. The results of the experiments are provided in Table 2 below, as well as graphically in FIG. 1.

TABLE 2

| Experiment Number | Type of Adsorbent | Breakthrough Time (hr) |
|---|---|---|
| 1 | 10 wt % $CsI_3$ on Activated Carbon | 96 |
| 2 | Commercial Adsorbent A | 20 |
| 3 | Commercial Adsorbent B | 17 |
| 4 | Commercial Adsorbent C | 28 |

As can be seen from both Table 2 and FIG. 1, the breakthrough time observed in respect of a metal perhalide according to the present invention, supported on activated carbon, substantially out-performed the commercially available Absorbents A to C (not of the invention) in terms of mercury extraction over time.

Example 4

Removal of Mercury from a Gas Phase Fluid

The experiment described in Example 3 was repeated apart from unsupported $CsI_3$ was used in place of the supported material. In this example, unsupported $CsI_3$ was able to substantially remove elemental mercury from the gaseous nitrogen stream; reducing the mercury concentration of the stream from 30 mg/m$^3$ (inlet) to below 0.1 μg/m$^3$ (outlet).

Example 5

Removal of Mercury from a Liquid Phase Hydrocarbon Fluid

A supported $CsI_3$ material was prepared in a similar manner to that described in Example 2, apart from alumina (A8) was added to the solution such that a supported $CsI_3$ (10 wt % on alumina) was formed on evaporation of the solvent. The supported material was milled to a mesh size of between from 20 to 30 and subsequently used in a sealed reactor vessel supplied with a mercury-containing liquid hydrocarbon stream at a flow rate of 1 ml/min.

A commercially available, conventional metal halide on activated carbon—Absorbent D, and a conventional metal sulfide on activated carbon—Absorbent E, (both having 8 to 12 wt. % active concentration) were also independently used in separate mercury extractions using the same experimental protocol. Breakthrough time, which is defined as the time required from the start of the extraction process to the point in time where the mercury concentration in the outlet stream of the reactor reached up to 30% of the mercury concentration of the inlet stream, was measured in each case. The results of the experiments are provided in Table 3 below, as well as graphically in FIG. 2.

TABLE 3

| Experiment Number | Type of Adsorbent | Breakthrough Time (hr) |
|---|---|---|
| 5 | 10 wt % $CsI_3$ on Alumina | 9.5 |
| 6 | Commercial Adsorbent D | 4.5 |
| 7 | Commercial Adsorbent E | <1 |

Figure 2:
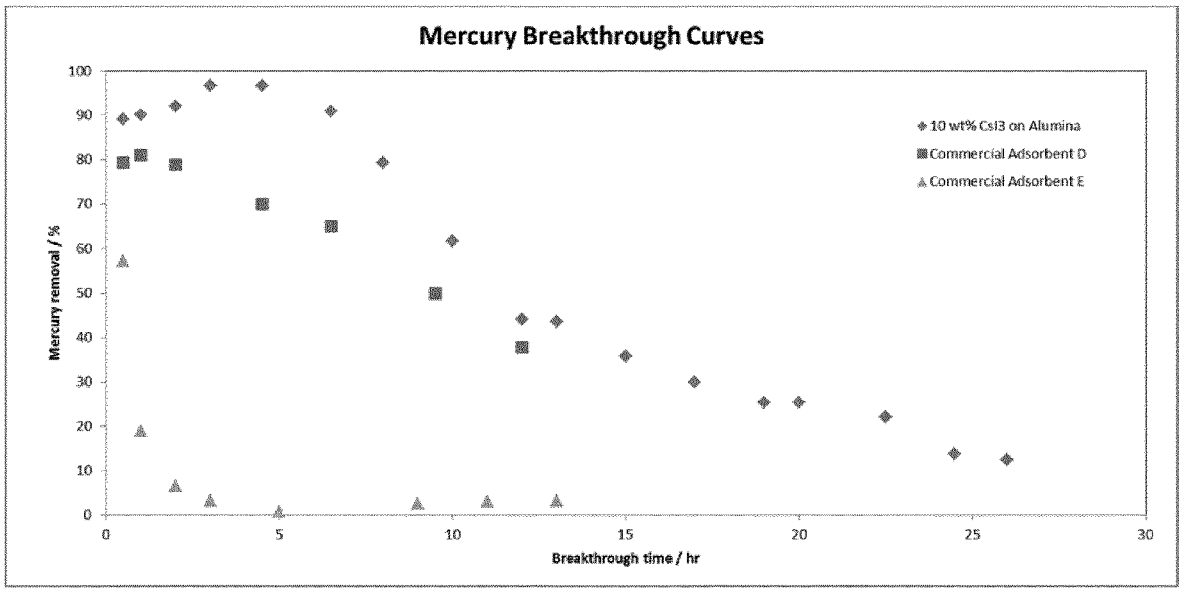

As can be seen from both Table 3 and FIG. 2, the breakthrough time observed in respect of a metal perhalide according to the present invention, which is supported on alumina, substantially out-performed the commercially available Absorbents D and E (not of the invention) in terms of mercury extraction over time.

The invention claimed is:

1. A process for the removal of mercury from a mercury-containing hydrocarbon fluid feed comprising the steps of:

contacting the mercury-containing hydrocarbon fluid feed with a metal perhalide having the following formula:

$[M]^+[X]^-$ wherein: $[M]^+$ represents one or more metal cations wherein the metal has an atomic number greater than 36; an atomic radius of at least 150 pm and a 1$^{st}$ ionization energy of less than 750 kJmol$^{-1}$; $[X]^-$ represents one or more perhalide anions; and obtaining a hydrocarbon fluid product having a reduced mercury content compared to mercury-containing hydrocarbon fluid feed.

2. A process according to claim 1, wherein $[M]^+$ is selected from an alkali metal or a post-transition metal cation.

3. A process according to claim 1, wherein $[M]^+$ is selected from rubidium, caesium, thallium or bismuth cations.

4. A process according to any of claim 1, wherein $[M]^+$ is a caesium cation.

5. A process according to any of claim 1, wherein $[X]^-$ comprises at least one perhalide anion selected from $[I_3]^-$, $[BrI_2]^-$, $[Br_2I]^-$, $[ClI_2]^-$, $[Br_3]^-$, $[ClBr_2]^-$, $[BrCl_2]^-$, $[ICl_2]^-$, or $[Cl_3]^-$.

6. A process according to claim 5, wherein $[X^-]$ comprises at least one perhalide anion selected from $[BrI_2]^-$, $[Br_2I]^-$, $[ClI_2]^-$, $[ClBr_2]^-$, $[BrCl_2]^-$, or $[ICl_2]^-$.

7. A process according to claim 5, wherein $[X^-]$ comprises at least one perhalide anion selected from $[I_3]^-$, $[Br_3]^-$, or $[Cl_3]^-$.

8. A process according to any of claim 1, wherein the metal perhalide is caesium periodide, or rubidium periodide.

9. A process according to claim 1, wherein the mercury is in elemental, particulate, or organic form.

10. A process according to claim 1, wherein the mercury concentration in the mercury-containing hydrocarbon fluid feed is in the range of from 1 to 50,000 parts per billion.

11. A process according to claim 1, wherein the mercury-containing hydrocarbon fluid feed is a liquid.

12. A process according to claim 11, wherein the mercury-containing hydrocarbon fluid feed comprises one or more of:

a liquefied natural gas;

a light distillate comprising at least one member of a group consisting of: liquid petroleum gas, gasoline, and naphtha;

a natural gas condensate;

a middle distillate comprising at least one member of a group consisting of:

kerosene and diesel;

a heavy distillate; and a crude oil.

13. A process according to claim 1, wherein the mercury-containing hydrocarbon fluid feed is a gas.

14. A process according to claim 13, wherein the mercury-containing hydrocarbon fluid feed comprises at least one member of a group consisting of natural gas and refinery gas.

15. A process according to claim 1, wherein the metal perhalide is in the form of a neat salt.

16. A process according to claim 1, wherein the metal perhalide is supported by a solid carrier material.

17. A process according to claim 16 wherein the solid carrier material is a porous material.

18. A process for the removal of a toxic heavy metal selected from cadmium, mercury, indium, thallium, germanium, tin, lead, arsenic, antimony, bismuth, selenium, tellurium and polonium from a heavy metal-containing hydrocarbon fluid feed comprising the steps of:

contacting the heavy metal-containing hydrocarbon fluid feed with a metal perhalide having the following formula:

$$[M]^+[X]^-$$

wherein: $[M]^+$ represents one or more metal cations wherein the metal has an atomic number greater than 36; an atomic radius of at least 150 pm and a $1^{th}$ ionization energy of less than 750 $kJmol^{-1}$; $[X]^-$ represents one or more perhalide anions; and obtaining a hydrocarbon fluid product having a reduced toxic heavy metal content compared to the heavy metal-containing hydrocarbon fluid feed.

19. A process according to claim 18, wherein $[M]^+$ is selected from an alkali metal or a post-transition metal cation.

20. A process according to claim 18, wherein $[X]^-$ comprises at least one perhalide anion selected from $[I_3]^-$, $[BrI_2]^-$, $[Br_2I]^-$, $[ClI_2]^-$, $[Br_3]^-$, $[ClBr_2]^-$, $[BrCl_2]^-$, $[ICl_2]^-$, or $[Cl_3]^-$.

* * * * *